United States Patent [19]

Van den Hoven

[11] 4,301,579

[45] Nov. 24, 1981

[54] WIDENING-NARROWING GUIDE FOR TEXTILE FILAMENT BUNDLE

[75] Inventor: Gerardus Van den Hoven, Raamsdonksveer, Netherlands

[73] Assignee: E. I. Du Pont de Nemours and Company, Wilmington, Del.

[21] Appl. No.: 38,733

[22] Filed: May 14, 1979

[51] Int. Cl.[3] ..... D02J 1/18; D02G 1/12

[52] U.S. Cl. ..... 28/282; 28/212; 28/248; 28/268; 26/105

[58] Field of Search ..... 28/212, 213, 268, 282, 28/248; 26/105; 242/157 R; 226/199; 57/352

[56] References Cited

U.S. PATENT DOCUMENTS

| | | | |
|---|---|---|---|
| 1,419,049 | 6/1922 | Harsel et al. . | |
| 2,690,313 | 4/1954 | McDermott | 28/212 X |
| 2,717,037 | 9/1955 | Goodwillie . | |
| 2,952,201 | 9/1960 | Gibson . | |
| 3,130,453 | 4/1964 | Haigler, Jr. | 28/282 X |
| 3,145,429 | 8/1964 | Resor . | |
| 3,218,675 | 11/1965 | Hendrix | 28/268 |
| 3,231,958 | 2/1966 | Chadwick . | |
| 3,240,442 | 3/1966 | Kilmartin . | |
| 3,248,103 | 4/1966 | Tarbell . | |
| 3,255,507 | 6/1966 | McCaskill . | |
| 3,277,537 | 10/1966 | Roeder et al. . | |
| 3,739,566 | 6/1973 | Smith | 28/282 X |
| 3,980,251 | 9/1976 | Wyatt | 28/213 X |

FOREIGN PATENT DOCUMENTS

| | | | |
|---|---|---|---|
| 2455154 | 5/1975 | Fed. Rep. of Germany | 28/282 |
| 7009897 | 1/1971 | Netherlands . | |
| 82966 | 4/1920 | Switzerland | 26/105 |

*Primary Examiner*—Robert Mackey

[57] ABSTRACT

A cylindrical guide for varying the width of a bundle of continuous filaments has a surface in contact with the bundle that has an array of nonparallel grooves. The grooves converge until a minimum distance is reached on the guide surface and from thereon diverge to a maximum distance. With this arrangement of grooves it is possible to control the width of the bundle of filaments in a widening or narrowing manner by simply rotating the cylindrical guide one direction or the other until the desired width is reached.

8 Claims, 7 Drawing Figures

WIDENING-NARROWING GUIDE FOR TEXTILE FILAMENT BUNDLE

BACKGROUND OF THE INVENTION

This invention relates to the production of synthetic fibers and it is particularly concerned with that phase of fiber production which involves the formation of tow just prior to crimping the fibers.

It is well established in the art that crimping of continuous-filament tows in stuffing box crimpers poses special problems. In order to impart uniform crimp, it is necessary to treat each filament in the tow the same and to treat each increment of length the same as another. To treat each filament and each increment of length the same in passing through a stuffing box crimper it is necessary to precisely control the width of the tow to prevent uneven filling which causes extreme pressures on the filaments and high friction between filaments and the crimper that damage filaments. Efforts toward this ideal have taken the form of stuffing rolls modification intended to adapt to the tow characteristics, as exemplified by the McCaskill U.S. Pat. No. 3,255,507 as well as adjustments in the configuration of the tow being fed to the stuffing rolls such as illustrated by the Resor U.S. Pat. No. 3,145,429, the Chadwick U.S. Pat. No. 3,231,958, the Tarbell U.S. Pat. No. 3,248,103 and the Roeder et al. U.S. Pat. No. 3,277,537. The McCaskill patent adapts the shape of the crimper roll faces to the somewhat oval cross-section of tow being fed to them. The Resor patent teaches the use of concave and uniform-diameter rolls for shaping individual bundles of wash-drawn tows and directing them to a usable, stacked arrangement for crimping. The Chadwick patent offers an alternative to the McCaskill solution in which means are provided for folding over the feathered edges to result in a uniform crimper feed. The Tarbell patent teaches an improved use of pins for stacking, which shapes and narrows the ropes by means including twice rotating them 90°. The Roeder et al. patent teaches the importance of maintaining the rope through a minimum distance at narrower configuration; this prevents "spring back" to the initial width after passing the guide.

However, none of the above-noted references are capable of varying the width of th rope in both a widening and narrowing mode by simply adjusting its angular position with respect to the rope.

SUMMARY OF THE INVENTION

A guide for varying the width of a textile rope of continuous parallel filaments moving in a path is comprised of an elongated member positioned across the path in contact with the rope. The member has a curved surface facing the path. There is a plurality of grooves in the curved surface arranged in an array that converges to a minimum dimension on the surface, then thereafter diverges from the minimum dimension, or that diverges until a maximum dimension is reached, then converges from that maximum dimension.

Preferably, the elongated member is a cylinder with each groove lying in a discrete plane and circling back on itself. The planes of the grooves are in a nonparallel array symmetrical about a plane passing through the center of the cylinder and perpendicular to its axis. The spacing of one groove to the next is such that the distance from one groove to the next as measured along a cross section parallel to the longitudinal axis of the cylinder is a constant.

DETAILED DESCRIPTION OF THE PREFERRED EMBODIMENTS

Figure 1:
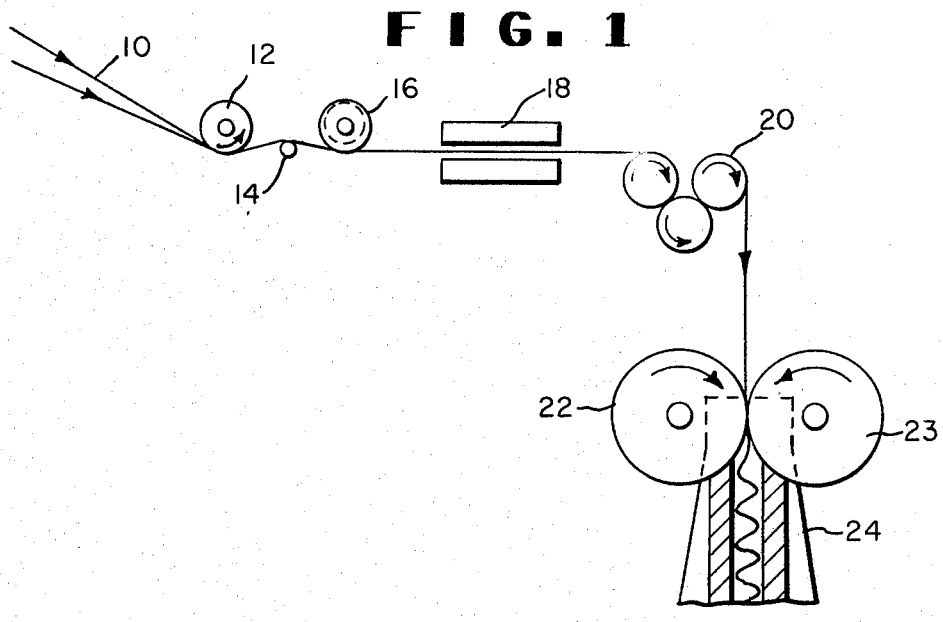
FIG. 1 is a diagrammatic representation of an apparatus layout in which tow is passed in contact with the guide of this invention then through a steam chamber and finally into a conventional stuffer box crimper.

Referring now to FIG. 1, a tow 10 is passed under roller 12, over guide 14 and under the grooved guide of the invention 16 at a break angle sufficient to provide lateral support in its grooves for the tow 10 before going through a steam treatment chamber 18 past forwarding rolls 20 and finally through the nip rolls 22, 23 of a conventional stuffer box crimper 24.

Figure 2:
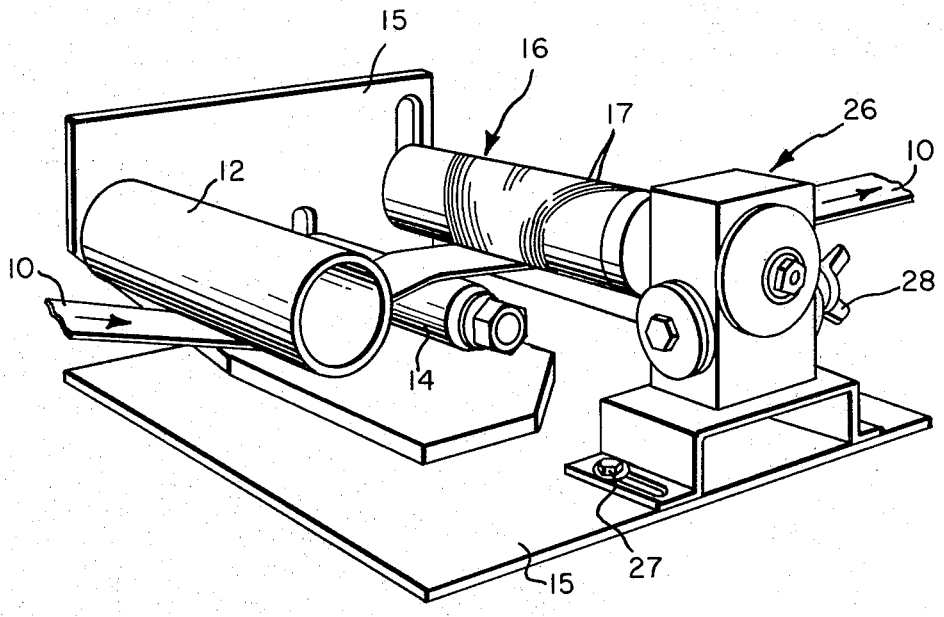
FIG. 2 is a perspective view of the guide of the invention mounted on the apparatus frame with a means to adjust its angular position.

FIG. 2 shows the grooved guide 16 of this invention rotatably mounted to the apparatus frame 15 at one end and coupled to a gear reducer 26 at its other end. The gear reducer is bolted to the apparatus frame 15 by means of bolts 27 (only one shown) on each side of its base. A wing nut 28 is fixed to the worm of the gear reducer and serves as an operational handle so that a controlled amount of angular movement of the wing nut in either a clockwise or a counterclockwise direction transmits angular movement to the grooved guide 16 through the gear reducer. The roller guide 12 is rotatably mounted to frame 15 upstream from the grooved guide 16 and between the roller 12 and the grooved guide 16, a guide 14 is mounted to the frame 15 for adjustable vertical movement. The tow 10 is fed under roller guide 12, over guide 14 and under grooved guide 16 with a break angle or degree of encirclement with respect to each. The break angle with respect to guide 16 is about 10 degrees which is sufficient to provide lateral support in the grooves 17 for the tow to control its width. The break angle may be changed by changing the vertical position of guide 14. In the position shown, the grooves 17 of the guide engage the tow at a location between the minimum distance to which the grooves converge and the maximum distance to which they diverge.

Figure 3:
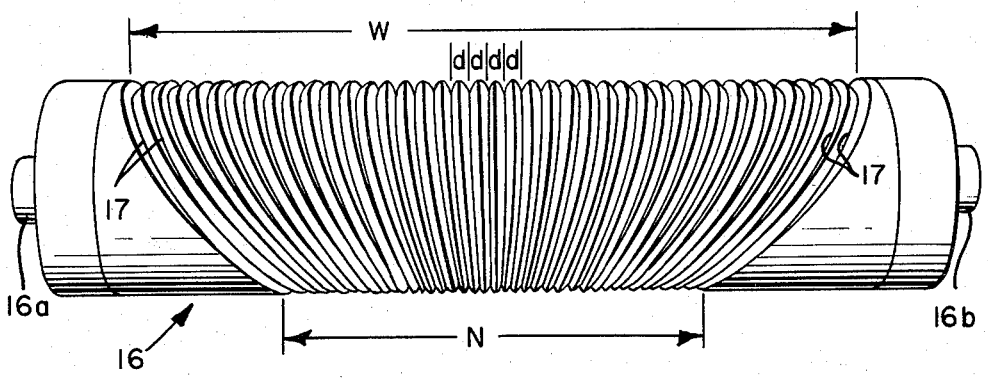
FIG. 3 is a view of the guide of the invention showing the grooves of the guide diverging from a minimum distance to a maximum distance.
Figure 4:
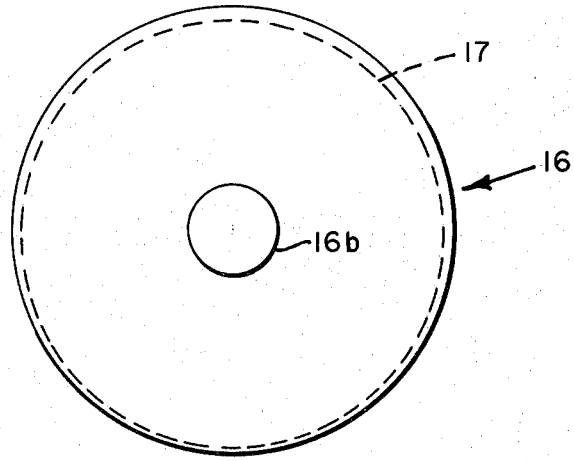
FIG. 4 is an end view of the guide of FIG. 3.

As best seen in FIGS. 3 and 4, the guide 16 of this embodiment is in the form of a cylinder with mounting shafts **16*a*, 16*b* located at each end on the longitudinal axis of the cylinder. The cylinder has been machined to provide a plurality of v-shaped grooves 17**, each groove being in a discrete plane and circling back on itself. The planes of the grooves are arranged in a nonparallel array with the array converging in one direction to a minimum dimension N and then diverging from the minimum dimension in the opposite direction to a maximum dimension W. The distance d from one groove to the next as measured along a cross section parallel to the longitudinal axis of the cylinder is a constant.

In the array of grooves illustrated, all grooves lie entirely within planes which bisect the guide at varying angles. The imaginary surfaces resulting from cutting the cylinder along a given groove are planar ellipses in all cases except for that along any center line groove that may be present (which is a planar circle).

As seen from the Figures, the function of the guide to vary the width of the tow coming in contact with the grooves can be varied infinitely between widening on the one hand and narrowing on the other hand by simply rotating the cylinder on its longitudinal axis.

Figure 5:
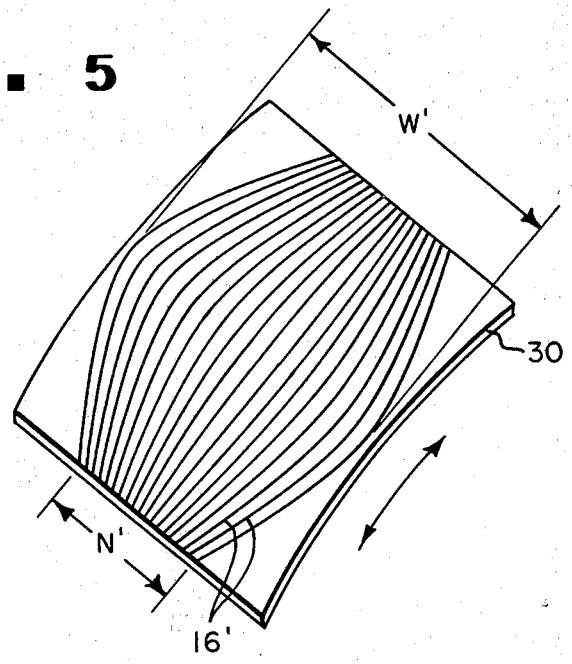
FIGS. 5 and 6 are perspective views of movable convexly curved plates each containing a plurality of grooves in arrays according to the invention.
Figure 6:
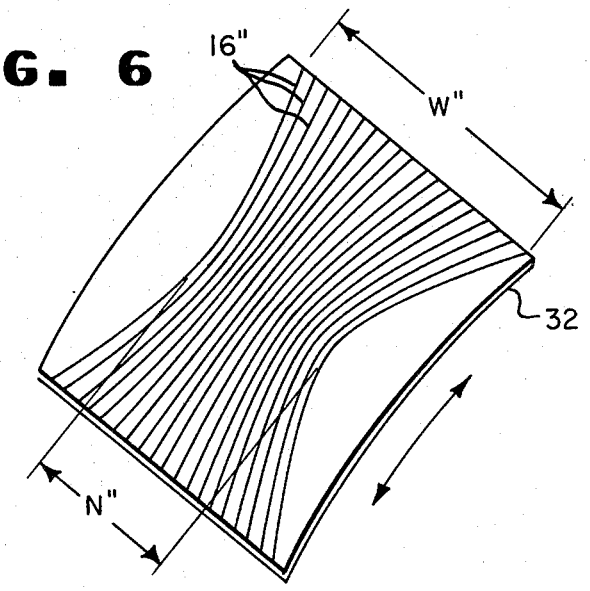

Although the guide of this invention has been disclosed in the form of a cylinder, other curved surfaces will serve as well as long as they contain a plurality of grooves which ether converge in the manner described until a minimum distance is reached, then diverge from that minimum distance or diverge in the manner described until a maximum distance is reached, then converge from that maximum distance. More particularly, referring to FIGS. 5 and 6, convexly curved movable plates 30, 32 are shown to contain a plurality of grooves 16', 16'', respectively. The grooves 16' in plate 30 are shown to diverge until a maximum distance W' is reached then converge until a minimum distance N' is reached. In the other embodiment, the grooves 16'' in plate 32 are shown to converge until a minimum distance N'' is reached, then diverge until a maximum distance W'' is reached.

Figure 7:
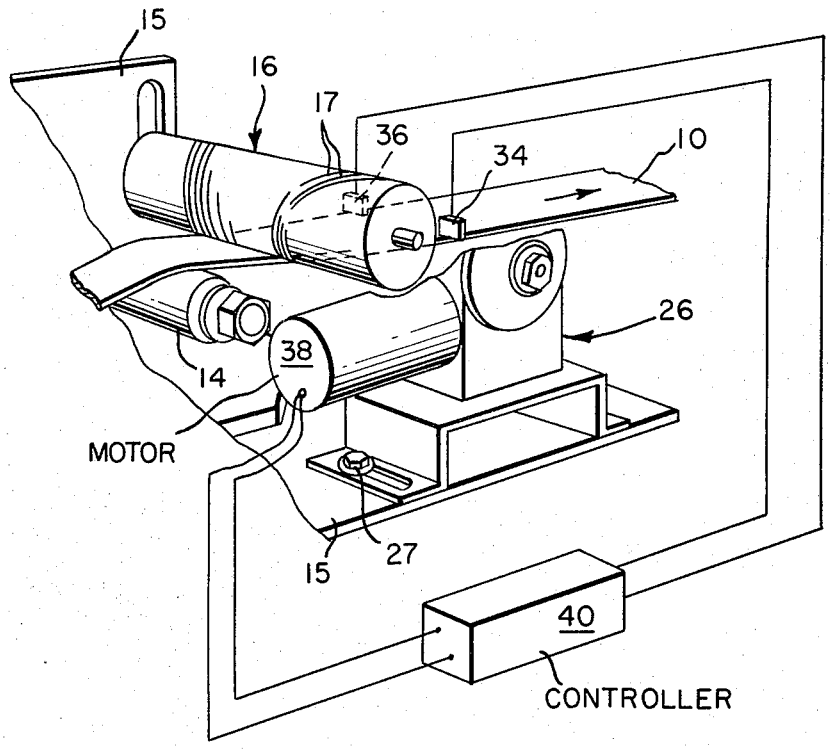
FIG. 7 is a perspective view of the guide of the invention mounted on the apparatus frame equipped for automated adjustment in response to a bandwidth sensor.

While the cross section of the grooves has been illustrated as v-shaped, other suitable cross sections for the groove will work as well, for example, semi-circular, rectangular of a groove with tapered walls and a flat bottom or other configurations which take into account the requirements of the specific conditions. As seen from the foregoing, the grooved guide of this invention may be used to variably broaden or variably narrow a moving band of tow, the direction and degree of change being selected by a combination of rotation of the guide around its longitudinal axis and variation in the amount of wrap taken by the tow band around the guide. This adjustment of tow width is far more convenient than with prior art guides which require rotation end-for-end to reverse direction of width change from wide to narrow or vice-versa. Further, the guide of this invention enables automated adjustment by servomechanism (i.e., motor 38 and controller 40 in FIG. 7) responsive to a bandwidth sensor 34, 36 in FIG. 7. Prior art guides are adjustable to such control only for degree of change within a single direction of width change for a given end-for-end installation.

What is claimed is:

1. A guide for varying the width of elongated flexible material moving in a path, said guide comprising: an elongated member positioned across said path, said member having a curved surface facing said path with a plurality of grooves therein, said grooves being in a nonparallel array, there being equidistant separation of the grooves along any line perpendicular to the length of the array, said array of grooves converging to a minimum dimension on said surface then thereafter diverging from said minimum dimension in the general direction of said path whereby unidirectional rotational movement of said curved surface engaging said material in said grooves will converge then diverge the width of said material.

2. A guide for varying the width of elongated flexible material moving in a path, said guide comprising: an elongated member positioned across said path, said member having a curved surface facing said path with a plurality of grooves therein, said grooves being in a nonparallel array, there being equidistant separation of the grooves along any line perpendicular to the length of the array, said array of grooves diverging to a maximum dimension on said surface and thereafter converging from said maximum dimension in the general direction of said path whereby unidirectional rotational movement of said curved surface engaging said material in said grooves will diverge then converge the width of said material.

3. A guide for varying the width of elongated parallel flexible structures moving in a path, said guide comprising: a rotatable elongated member positioned across said path, said member having a curved surface facing said path with a plurality of grooves therein, said grooves lying in discrete planes, the planes of said grooves being in a nonparallel array, there being equidistant separation of the grooves along any line perpendicular to the length of the array, said array converging in one direction to a minimum dimension and then diverging from said minimum dimension in the general direction of said path whereby unidirectional rotational movement of said curved surface engaging said structures in said grooves will converge and then diverge said structures.

4. The guide as defined in claim 1, 2 or 3, said array being symmetrical about a plane passing through the center of said guide and perpendicular to its transverse axis.

5. The guide as defined in claim 1, 2 or 3, said grooves having a v-shaped cross section.

6. The guide as defined in claim 1, 2 or 3, said guide member being a portion of a cylinder.

7. The guide as defined in claim 1, 2 or 3, said guide member being a cylinder, each groove laying in a discrete plane and circling back on itself to form an ellipse.

8. An apparatus for varying the width of a moving tow of essentially parallel continuous filaments, said apparatus comprising: a cylinder positioned across said moving tow, said cylinder being rotatable about its longitudinal axis and having a surface contacting said tow, said surface having a plurality of grooves therein, each groove lying in a discrete plane and circling back on itself to form an ellipse, the distance from one groove to the next as measured along a cross section parallel to the longitudinal axis of the cylinder being a constant distance, said planes forming a nonparallel array symmetrical about a plane passing through the center of the cylinder and perpendicular to its axis, said array converging in one direction and diverging in the opposite direction whereby unidirectional rotation of said cylinder with the grooves engaging said tow controls the width of said tow in a widening and narrowing manner.

* * * * *